US005251991A

United States Patent [19]

Akutsu

[11] Patent Number: 5,251,991

[45] Date of Patent: Oct. 12, 1993

[54] ROLL-POINT PEN

[76] Inventor: Yoshihito Akutsu, 36, Minami 6-Jo 1-chome, Ashiyoro-cho, Ashiyoro-gun, Hokkaido, Japan

[21] Appl. No.: 947,360

[22] Filed: Sep. 18, 1992

Related U.S. Application Data

[63] Continuation of Ser. No. 782,174, Oct. 24, 1991, abandoned.

[30] Foreign Application Priority Data

Oct. 26, 1990 [JP] Japan ..... 2-289670

[51] Int. Cl.[5] ..... B43K 8/20

[52] U.S. Cl. ..... 401/208; 401/216

[58] Field of Search ..... 401/208, 216

[56] References Cited

U.S. PATENT DOCUMENTS

| | | | |
|---|---|---|---|
| 449,233 | 3/1891 | Porter | 401/208 |
| 2,029,056 | 1/1936 | Carlson | 401/208 |
| 2,487,483 | 11/1949 | Seckers | 401/216 |
| 2,504,189 | 4/1950 | Ehrhart et al. | 401/208 |
| 3,085,554 | 4/1963 | Caplin | 401/208 |

FOREIGN PATENT DOCUMENTS

| | | | |
|---|---|---|---|
| 3615094 | 11/1987 | Fed. Rep. of Germany | 401/208 |
| 962771 | 12/1949 | France | 401/208 |
| 1007270 | 2/1952 | France | 401/208 |
| 427291 | 11/1947 | Italy | 401/208 |
| 434909 | 5/1948 | Italy | 401/208 |
| 1193611 | 6/1970 | United Kingdom | 401/208 |

*Primary Examiner*—Steven A. Bratlie

*Attorney, Agent, or Firm*—Armstrong, Westerman, Hattori, McLeland & Naughton

[57] ABSTRACT

A roll-point pen in which a roll having an ellipsoidal portion is held rotatably, around the longer axis thereof as a center, to a tip of a pen holder having an ink reservoir. A plurality of ridges are formed, each being oblique to the longer axis of the ellipsoidal portion, so that a rotational force is provided to the roll due to friction between it and the surface of a paper sheet when the roll is drawn in the direction of the longer axis thereof.

3 Claims, 3 Drawing Sheets

ROLL-POINT PEN

This application is a continuation of application Ser. No. 782,174 filed Oct. 24, 1991 now abandoned.

BACKGROUND OF THE INVENTION

1. Field of the Invention

The present invention generally concerns a novel writing utensil having an ellipsoidal roll held to the top end of a tip which is similar to a ball-point pen.

2. Description of the Prior Art

In a conventional ball-point pen, a ball of a completely spheroidal shape is rotatably held to the top end of a tip.

Since the ball is in a completely spheroidal shape, the conventional ball-point pen has an advantage of being able to raise a pen top to any direction but, on the other hand, it involves several drawbacks because of the completely spheroidal shape.

For instance, since the thickness (width) of a line drawn by the ball of the completely spheroidal shape does not change so much even when a pressure applied on the pen top is adjusted, it cannot draw a line of varying thicknesses. Accordingly, the conventional ball-point pen is not suitable for writing a so-called tasteful or refined letter with lines of varying thicknesses, such as Japanese letters or designed letters.

A traditional writing brush or a pen with split tip can draw such letters as described above, but a cap is indispensable to the writing utensil of this kind for protecting a writing portion or preventing an ink from coagulation or deposition, which is troublesome.

In addition, since the completely spheroidal ball rotates freely in all directions, its running direction is unstable, thereby leading to a drawback in that the writing stroke tends to undesirably turn to an unexpected direction.

OBJECT OF THE INVENTION

It is, accordingly, a principal object of the present invention to provide a writing utensil capable of writing a line or the like of varying thicknesses, stabilizing the writing stroke and not requiring a cap for the writing portion.

Another object of the present invention is to provide a writing utensil as described above, having an ellipsoidal roll rotatable around a longer axis as the center and capable of providing the roll with a rotational force upon drawing a line along the direction of the longer axis of the roll.

SUMMARY OF THE INVENTION

The main object of the present invention can be attained by a roll-point pen in which a roll having an ellipsoidal portion is rotatably held, around a longer axis thereof as the center, to a tip disposed at the top end of an ink reservoir.

Another object of the present invention can be attained by the roll pen as described above in which a plurality of ridges are further formed to the circumferential surface of the ellipsoidal portion of the roll such that each of the ridges is oblique to the longer axis of the ellipsoidal portion. In the present invention, small semi-spheroidal portions formed, respectively, on both axial ends of the longer axis of the roll may be held rotatably to the tip.

Alternatively, cylindrical or conical pivots may be integrally disposed to the small semi-spheroidal portions formed, respectively, on both axial ends and they may be pivotally disposed to the tip.

In the roll-point pen according to the present invention, the writing portion comprises an ellipsoidal roll and, accordingly, the roll abuts against the surface of a paper sheet at an ellipsoidally convex surface. Therefore, when the pen is driven in a certain direction, in particular, perpendicular to the longer axis x of the ellipsoid as shown in FIG. 10, lines of various thicknesses (widths) such as $a_1$ or $a_2$ in the figure can be drawn depending on a pressure applied to the roll.

Further, as shown in FIG. 11, the width of the spheroid abutting against the surface of the paper sheet becomes maximum in the direction A perpendicular to the longer axis and becomes minimum in the direction B parallel with the longer axis. Further, the abutting width to the surface of the paper sheet corresponds to the width of the longer axis projected at an angle of inclination when it is drawn in the oblique direction C. Accordingly, lines of varying thicknesses, such as a, b, c, $c_2$, can be drawn depending on the writing direction (that is, longitudinal, lateral or oblique direction) even when an identical pressure is applied to the pen tip.

Further, since the ellipsoidal roll rotates only in one direction, the direction of the writing stroke is stabilized.

DESCRIPTION OF THE ACCOMPANYING DRAWINGS

These and other object, as well as advantageous features of the present invention will become apparent by reading the following descriptions of the preferred embodiments of the present invention with reference to the accompanying drawings, wherein FIG. 1 is a vertical cross sectional view of a portion of a roll-point pen according to the present invention;

DESCRIPTION OF THE PREFERRED EMBODIMENTS

The present invention will now be described in more detail for the preferred embodiments shown in the appended drawings.

Figure 1:
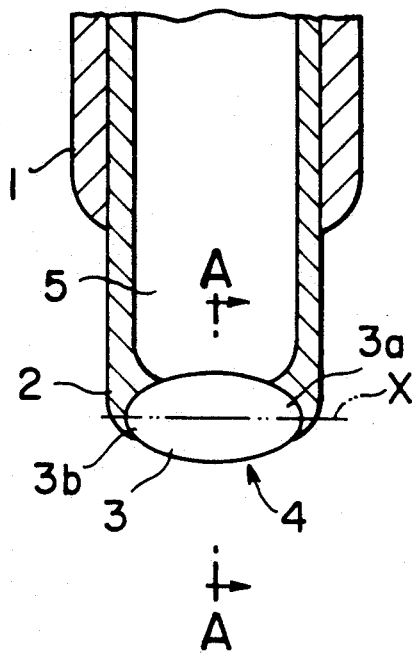
Figure 2:
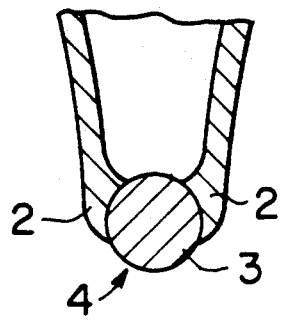
FIG. 2 is a vertical cross sectional view taken along lines A—A shown in FIG. 1.

As shown in FIG. 1, the roll-point pen according to the present invention comprises a pen holder 1, a tip 2 integrally protruded from the top end of the pen holder 1 and a roll 4 having an ellipsoidal portion 3 and attached as a writing portion to the top end of the tip 2.

The roll 4 is supported to the top end of the tip 2 such that it is rotatable around a longer axis X of the ellipsoidal portion 3 and the roll 4 is fitted in a liquid sealing fashion to an ink reservoir 5 formed inside of the tip 2.

Figure 3:
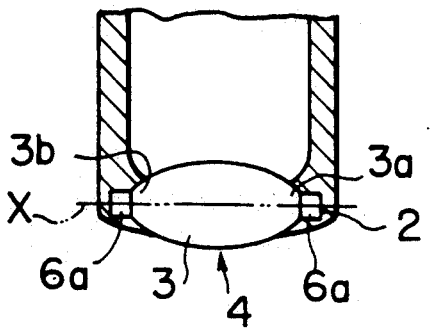
FIG. 3 is a vertical cross sectional view of a modification of the embodiment shown in FIG. 1.
Figure 4:
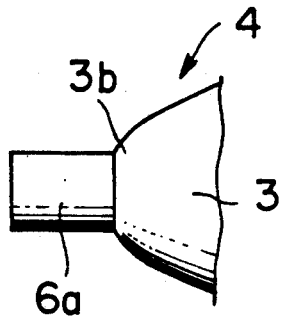
FIG. 4 is an enlarged view of a portion illustrated in FIG. 3.

In the first embodiment shown in FIG. 1, spheroidal portions 3*a*, 3*b* each of a smaller radius formed, on both ends of the ellipsoidal portion 3, are rotatably held respectively to the top end of the tip 2. Alternatively, cylindrical pivots 6*a*, 6*a* may be integrally disposed to the both ends of the ellipsoidal portion 3 as shown in FIGS. 3 and 4, and the pivots 6*a*, 6*a* may be pivotally disposed to the tip 2. Further, as shown in FIGS. 5 and 6, the cylindrical pivots 6*a* and 6*a* may be replaced with conical pivots 6*b* and 6*b*.

Figure 5:
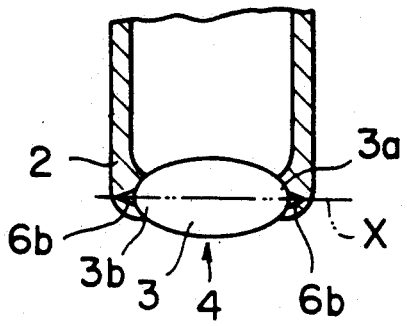
FIG. 5 is a vertical cross sectional view of a further modification of the modified embodiment shown in FIG. 1.
Figure 6:
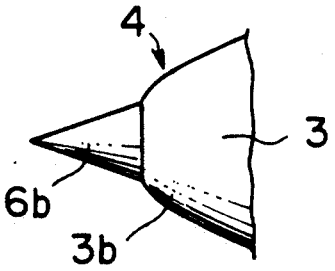
FIG. 6 is an enlarged view of a portion illustrated in FIG. 5.

In the embodiments shown in FIGS. 3 and 5, it is also preferred to hold a portion of each of the spheroidal surfaces 3*a* and 3*b* at both ends of the spheroidal portion 3 to the tip 2. When the portion of each of the spheroidal surfaces 3*a* and 3*b* is held to the tip 2, the liquid sealing performance and the stable rotational operation of the roll 4 can be attained.

Since the roll 4 rotates around the longer axis of the ellipsoidal portion 3 as the center, the roll-point pen of the embodiment shown in FIG. 1 is used as a writing utensil for drawing lines mainly in directions perpendicular and oblique to the longer axis.

Figure 7:
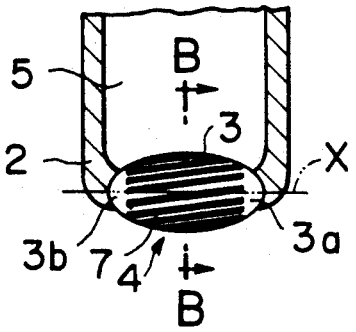
FIG. 7 is a vertical cross sectional view of a further embodiment of the roll-point pen according to the present invention.

In a further embodiment shown in FIG. 7, a plurality of ridges 7, each oblique to the longer axis X of the ellipsoidal portion 3, are formed to the circumferential surface of the ellipsoidal portion 3, so that the roll 4 is also rotatable when drawing a line in the direction of the longer axis of the ellipsoidal portion 3.

The oblique protrusions 7 constitute a means for providing the roll 4 with a torsional force due to the frictional resistance relative to the surface of the paper sheet (not illustrated), thereby causing the roll 4 to rotate.

Thus, in the embodiment illustrated in FIG. 7, when a line is drawn in the longer axis direction of the ellipsoidal portion 3 by abutting the portion against the surface of the paper sheet, the oblique ridges formed at the surface of the ellipsoidal portion 3 give a frictional resistance. Since the protrusions 7 are formed oblique to the longer axis direction of the ellipsoidal portion 3 as described above, a rotational force is applied to the roll 4 due to the frictional resistance between the oblique protrusions 7 and the surface of the paper sheet. As a result, portions of the ellipsoidal surface deposited with fresh ink are successively brought into contact with the surface of the paper sheet to draw a continuous line.

In this case, since the ellipsoidal portion 3 is brought into contact with the surface of the paper sheet at an ellipsoidal form extended in the direction of the writing stroke, an elongated ink retaining surface is obtained and writing with less scratching can be attained.

Figure 8:
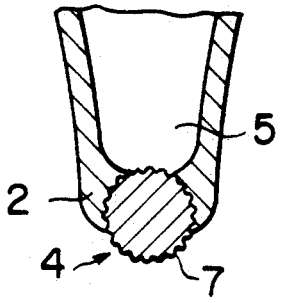
FIG. 8 is a vertical cross sectional view taken along lines B—B shown in FIG. 7.
Figure 9:
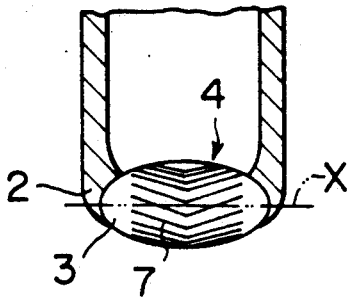
FIG. 9 is a vertical cross section view of a modification of a the embodiment shown in FIG. 7.
Figure 10:
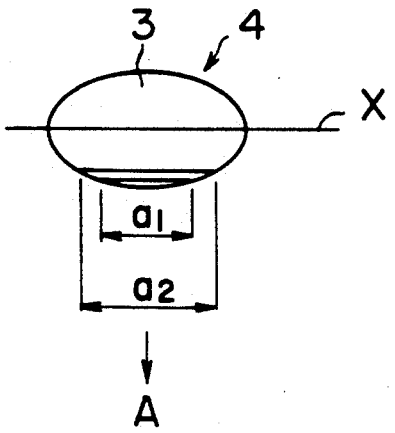
FIGS. 10 and 11 are explanatory views illustrating the operation of the roll-point pen according to the present invention.
Figure 11:
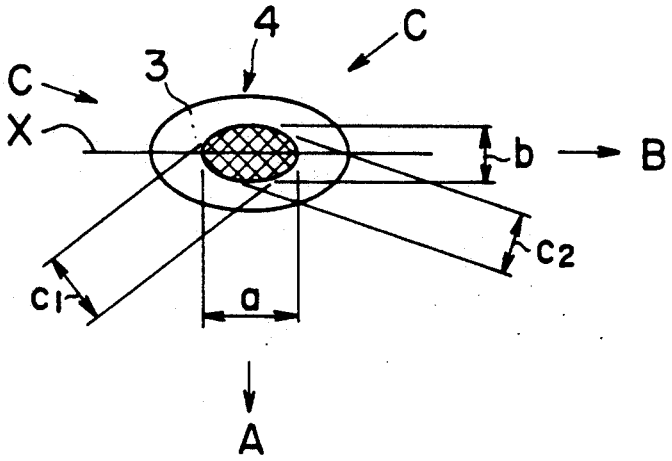

The oblique protrusions 7 may be of a plurality of linear segments each slanted in one direction as shown in FIG. 7 or they may be a plurality of segments each in a V-shaped shape as shown in FIG. 8.

Since the roll-point pen according to the present invention uses a roll having an ellipsoidal portion as a writing portion, lines of versatile thickness can be drawn depending on the pressure applied to the roll.

Further, since the roll is brought into contact at an elliptic shape with the surface of the paper sheet, the thickness of a line varies in each of the directions; that is, in the longitudinal, lateral or oblique direction, even when an identical pressure is applied to the roll. Accordingly, it is possible to draw a letter having different thicknesses of lines (such as, square or cursive styles, alphabetical as well as letters, musical notes, designed letters, etc.) can also be drawn with various characteristic expressions.

Further, since the roll of the writing portion rotates only in one direction, the direction of the writing stroke can be stabilized so as to draw well-regulated letters or graphs.

Furthermore, in the embodiment having oblique ridges formed in the ellipsoidal portion of the roll, since the rotational force is provided to the roll when drawing a line in the direction of the longer axis of the ellipsoidal portion, it is possible to draw the fine letters or graphs with no scratching.

While the invention has been particularly shown and described in reference to preferred embodiments thereof, it will be understood by those skilled in the art that changes in form and details may be made therein without departing from the spirit and scope of the invention.

What is claimed is:

1. A roll-point pen comprising:

an ink reservoir having a tip portion, said tip portion having a spheroidally-shaped inner surface; and a roll having an ellipsoidal portion and spheroidal portions, said roll being rotatably held, along a longest axis thereof, at said tip portion of said ink reservoir, wherein said ellipsoidal portion includes a plurality of ridges formed on the circumferential surface thereof such that each of the ridges is oblique relative to the longest axis of said roll, wherein a substantial portion of said ellipsoidal portion of said roll along said longest axis of said roll directly communicates with ink contained within said ink reservoir, and wherein said spheroidally-shaped inner surface of said tip portion substantially abuts said spheroidal portions of said roll.

2. A roll-point pen as defined in claim 1, wherein cylindrical pivots are respectively disposed on said spheroidal portions of said roll, and said cylindrical pivots are pivotally disposed to the tip portion of said reservoir.

3. A roll-point pen as defined in claim 1, wherein conical pivots are respectively disposed on said spheroidal portions of said roll, and said conical pivots are pivotally disposed to the tip portion of said reservoir.

* * * * *